United States Patent [19]

Cook

[11] 4,213,783

[45] Jul. 22, 1980

[54] PHOTOGRAPHIC FILM SUBBING LAYER COMPRISING VINYLIDENE CHLORIDE AND ITACONIC ACID OR ESTER COPOLYMER

[75] Inventor: Alan H. Cook, Manningtree, England

[73] Assignee: Bexford Limited, London, England

[21] Appl. No.: 728,918

[22] Filed: Oct. 4, 1976

[30] Foreign Application Priority Data

Oct. 13, 1975 [GB] United Kingdom ..... 41838/75

[51] Int. Cl.[2] ..... G03C 1/80

[52] U.S. Cl. ..... 430/533; 428/483; 526/303

[58] Field of Search ..... 96/87 R; 428/483; 526/303

[56] References Cited

U.S. PATENT DOCUMENTS

| | | | |
|---|---|---|---|
| 1,234,755 | 7/1917 | Agfa | 56/400.1 |
| 1,286,457 | 12/1918 | Agfa | 151/25 R |
| 2,943,937 | 7/1960 | Nadeau et al. | 96/87 R |
| 3,236,818 | 2/1966 | Covington | 526/303 |

FOREIGN PATENT DOCUMENTS 2193072 2/1974 France .

OTHER PUBLICATIONS

Chemical Abstracts vol. 75, (1971) col. 142110h.

*Primary Examiner*—John D. Welsh
*Attorney, Agent, or Firm*—Cushman, Darby & Cushman

[57] ABSTRACT

Subbing layers in photographic films especially for polyester such as polyethylene terephthalate film supports comprise copolymers of 75 to 90 mole % of vinylidene chloride, 2 to 16 mole % of acrylonitrile or methacrylonitrile or a copolymerizable ester, e.g. methyl acrylate or vinyl acetate, 0.5 to 5 mole % of itaconic acid or a monoalkyl ester of itaconic acid wherein the alkyl group contains 1 to 4 carbon atoms and 3 to 8 mole % of acrylamide, methacrylamide or N-methylolacrylamide.

15 Claims, No Drawings

PHOTOGRAPHIC FILM SUBBING LAYER COMPRISING VINYLIDENE CHLORIDE AND ITACONIC ACID OR ESTER COPOLYMER

The present invention relates to light-sensitive photographic films and in particular to subbing layers of copolymers of vinylidene chloride which are interposed between the light-sensitive photographic emulsion layer and an underlying film support to adhere the emulsion layer to the film support.

Copolymers of vinylidene chloride are known as subbing layers, especially for use with film supports of linear polyesters such as polyethylene terephthalate. British specification 718,422 discloses copolymers of vinylidene chloride, and in particular copolymers of vinylidene chloride, an acrylic ester and itaconic acid, for application to polyester film supports prior to the molecular orientation of the film by stretching.

For certain specialised end uses, the adhesion of the subbing layer to the film support must be strong enough to withstand extreme treatment. For instance, extreme conditions of use arise in the graphic arts field in which lith films are occasionally treated with organic solvents such as methylated spirit in order to remove masking lacquers. Organic solvents which are compatible with water are also sometimes used to accelerate the final drying of photographic films. The resistance of some subbing layers to treatment with such solvents especially when the masking lacquers are removed by vigorous rubbing may be poor. Damage may also occur in processing equipment which employs edge grips for transporting the wet film through the equipment since considerable abrasion may result from contact with the grips. Additionally, in some instances the photographic film must withstand processing in highly alkaline solutions, e.g. at a pH of 12 to 13. It has been found that subbing layers of copolymers of vinylidene chloride, an acrylic ester and itaconic acid applied to the surface of a linear polyester film after the production of the film has been completed, i.e. after molecular orientation by stretching and heat setting, provide poor and variable adhesion.

It has been found that copolymers of vinylidene chloride and a copolymerisable amide provide subbing layers of satisfactory adhesion.

According to the present invention a photographic film comprises a self-supporting plastics film support, a subbing layer of a copolymer of vinylidene chloride applied to one or both surfaces of the film and a light-sensitive photographic emulsion layer applied over the subbing layer(s), wherein the subbing layer(s) comprise a copolymer prepared from:

75 to 90 mole % of vinylidene chloride,
2 to 16 mole % of a copolymerisable ester of a carboxylic acid, or acrylonitrile or methacrylonitrile,
0.5 to 5 mole % of itaconic acid or a monoalkyl ester of itaconic acid wherein the alkyl group contains 1 to 4 carbon atoms, and
3 to 8 mole % of acrylamide, methacrylamide or N-methylolacrylamide,
(mole percentages being based on the total comonomeric composition).

According to another aspect of the invention, a photographic film is produced by a process which comprises applying a subbing layer to one or both surfaces of a self-supporting plastics film support, said subbing layer comprising a copolymer prepared from:

75 to 90 mole % of vinylidene chloride,
2 to 16 mole % of a copolymerisable ester of a carboxylic acid, or acrylonitrile or methacrylonitrile,
0.5 to 5 mole % of itaconic acid or a monoalkyl ester of itaconic acid wherein the alkyl group contains 1 to 4 carbon atoms, and
3 to 8 mole % of acrylamide, methacrylamide or N-methylolacrylamide,
(mole percentages being based on the total comonomeric composition), and applying a light-sensitive photographic emulsion layer over the subbing layer(s).

The film support may be produced from any suitable linear polyester such as a polyester obtained by condensing one or more dicarboxylic acids or their lower alkyl diesters, e.g. terephthalic acid, isophthalic, phthalic, 2,5-, 2,6- and 2,6-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful for the production of the photographic films according to this invention.

The subbing layer(s) of the photographic films according to the present invention have excellent adhesion to the plastics film support and the superimposed light-sensitive photographic emulsion layer(s) have excellent adhesion via the subbing layer(s) to the film support. A particularly satisfactory combination of adhesion properties, including normal wet and dry adhesion, adhesion in alkaline developer and spirit resistance (assessed as described below) is exhibited by subbing copolymers prepared from the specific selection of acrylamide, methacrylamide or N-methylolacrylamide. Such properties are not exhibited by subbing copolymers derived from other amide comonomers such as other substituted amides of $\alpha,\beta$-unsaturated carboxylic acids. It has also been found that the acrylamide, methacrylamide and N-methylolacrylamide must be employed in amounts within the specifically selected range 3 to 8 mole % in order to provide the adhesion properties exhibited by the photographic films according to the invention.

The copolymerisable ester comonomer must be completely esterified and may comprise an ester of an $\alpha,\beta$-unsaturated monocarboxylic acid, e.g. acrylic or methacrylic acid, or of an $\alpha,\beta$-unsaturated dicarboxylic acid. When esters of $\alpha,\beta$-unsaturated dicarboxylic acids are employed, both carboxylic acid groups of the acid structure must be esterified. Suitable esters may be chosen from any of the esters which are normally copolymerised with vinylidene chloride and especially from methyl, ethyl, isobutyl, butyl, octyl, 2-ethylhexyl acrylates and methacrylates. Methyl acrylate is especially preferred as a monomer. Vinyl esters, such as vinyl acetate may also be employed. Preferably, the ester or acrylonitrile or methacrylonitrile is employed in an amount of 6 to 10 mole % of the total comonomeric composition.

The preferred alkyl itaconate comonomer is monomethyl itaconate. Preferably, the itaconic acid or alkyl itaconate is employed in an amount of 0.5 to 3 mole % of the total monomeric composition.

The acrylamide, methacrylamide or N-methylolacrylamide comonomer is preferably employed in an amount of 4 to 7 mole % of the total monomeric composition.

Preferred subbing copolymers comprise copolymers prepared from 82 to 88 mole % vinylidene chloride, 6 to 10 mole % methyl acrylate, 1 to 3 mole % itaconic acid and 5 to 7 mole % acrylamide. A particularly suitable subbing copolymer may be formed from 85 mole % vinylidene chloride, 6 mole % methyl acrylate, 2 mole % itaconic acid and 7 mole % acrylamide.

It has been found that the substitution in the known vinylidene chloride, acrylic ester and itaconic acid subbing copolymer of the itaconic acid comonomer by an amide comonomer as used according to this invention, such as acrylamide, results in poor adhesion of the light-sensitive photographic emulsion layers via the subbing layer to the base. However, when the unsaturated acid and the amide are both present according to this invention as essential comonomers, the adhesion of light-sensitive photographic emulsion layers to the film support is satisfactory.

The subbing copolymers used according to this invention may be prepared as aqueous dispersions by conventional polymerisation techniques in aqueous media. The aqueous dispersions are suitable for use in applying the subbing copolymer to the film surface.

If desired, the subbing copolymer composition may include cross-linking agents when the subbing copolymer contains cross-linkable functional groups.

The subbing copolymer composition may be applied to the film support by any suitable coating techniques, such as dip coating, bead coating, reverse roller coating or slot coating. The subbing layer should preferably be dried before coating with another layer to provide a dry coat weight from 0.1 to 10 mg/dm$^2$.

According to one embodiment of the invention, the subbing copolymer composition is applied to the film support after the production of the film has been completed. Such a process is suitable for the coating of films of linear polyesters, such as films of polyethylene terephthalate, the coating layer being applied after molecular orientation by stretching and heat-setting has been completed. Where desired, the surface of the film support may be firstly subjected to a pretreatment to enhance the adhesion of the subbing layer to the film support. Such pretreatment may comprise a physical treatment or treating the film surface with a priming agent or a solution of a priming agent which has a solvent or swelling action upon the film surface. When the film support is a linear polyester, e.g. polyethylene terephthalate, suitable priming agents comprise phenolic materials, e.g. resorcinol and hexylresorcinol, halogenated phenolic materials, e.g. para-chlororesorcinol, ortho-chlorophenol, para-chlorophenol and 4-chloro-3-methylphenol, chloral hydrate and halogenated fatty acids, e.g. trichloracetic acid, which may be applied to the film surface as solutions in suitable solvents. Alternatively, the surface of the film may be coated with a known polymeric adhesion-promoting layer, such as polymers of acrylic and/or methacrylic acids and/or esters thereof.

According to another embodiment of the invention, the subbing layer may be applied to the film support during the process for its production. For example, when the film support is a linear polyester such as polyethylene terephthalate which is molecularly oriented by stretching, it is possible to apply the subbing copolymer composition to the film surface before the stretching operation is commenced. Alternatively, since such films are usually biaxially oriented by stretching in two mutually perpendicular directions, the subbing copolymer composition may be applied to the film between the stretching steps which are effected in the two directions.

A conventional gelatin subbing layer may be applied over the vinylidene chloride subbing layer and the light-sensitive photographic emulsion layer applied over the gelatin subbing layer. The light-sensitive emulsion layer may comprise any conventional gelatinous silver halide composition.

Various other coatings normally used in the photographic art, such as anti-static and anti-halation layers, may be applied to the subbing copolymer layer.

The terms employed in this specification in relation to the adhesion properties of the subbing copolymers have the meanings and were assessed in the examples as described below:

"Normal wet adhesion" refers to the adhesion of the gelatino silver halide photographic emulsion in the final photographic film material, assessed after processing in standard photographic chemicals and washing in water for 15 minutes, by rubbing with a sponge over a series of lines scored in the still wet emulsion. The adhesion of the emulsion is graded from 1 to 5, Grade 1 being when no emulsion is removed from the edges of the score lines by 10 rubs with the sponge and Grade 5 being when all the emulsion is removed between the score lines by 10 rubs. The final photographic film material is generally only acceptable if the normal wet adhesion is Grade 1.

"Normal dry adhesion" refers to the adhesion of the gelatino silver halide photograhic emulsion in the final photographic film material, assessed, both before and after processing in standard photographic chemicals, by sticking a self-adhesive tape along a torn edge of the film and then ripping the tape off. The adhesion of the emulsion is graded from 1 to 5, Grade 1 being when no emulsion is removed after 8 pulls of the tape and Grade 5 being when all the emulsion is removed with one pull. The final photographic film material is generally only acceptable if the normal dry adhesion is Grade 1.

"Adhesion in alkaline developer" refers to the wet adhesion of the gelatino silver halide emulsion used in the final photographic film material, assessed, after processing in a highly alkaline activator at pH 12 followed by treatment in a stabiliser bath, by rubbing with a sponge over a series of lines scored in the still wet emulsion. The adhesion of the emulsion is graded from 1 to 5, Grade 1 being when no emulsion is removed by 10 rubs with the sponge and Grade 5 being when 10 rubs remove all the emulsion between the score lines. The final photographic film material is generally acceptable if the alkaline developer resistance is Grade 4-5 but when using stabilisation emulsions it is required to be Grade 1.

"Spirit resistance" refers to the resistance of the fully processed final photographic film material to swabbing with methylated spirit, assessed by immersing the processed photographic film in water for 30 seconds followed by immersing in methylated spirit for 30 seconds and then scoring the emulsion with a screwdriver. The spirit resistance of the emulsion is graded from 1–5, Grade 1 being when the score line has clean edges with no tearing back of the emulsion along the edges and Grade 5 being when the edges of the score are not clean, showing severe pulling of the emulsion along the score line. The final photographic film material is generally acceptable if the spirit resistance is Grade 3-3.5 but when used in graphic arts end uses it is required to be Grade 1-2 in some cases.

The invention is further illustrated by the following examples.

EXAMPLE 1

A biaxially oriented polyethylene terephthalate film support, 0.004 inch thick, was pretreated with a solution containing 3 g of p-chlororesorcinol and 0.06 g of a solution of 4-hexylresorcinol per 100 g of water, dried at 90° C. and seasoned for 15 seconds at 90° C.

An aqueous dispersion of a vinylidene chloride subbing copolymer was prepared by admixing the following constituents in a reaction vessel and allowing the polymerisation to run to completion:

| | Quantity | Mole % of monomers |
|---|---|---|
| Vinylidene chloride | 824.5 g | 85 |
| Methyl acrylate | 51.6 g | 6 |
| Itaconic acid | 26.0 g | 2 |
| Acrylamide | 49.7 g | 7 |
| Ammonium persulphate | 1.5 g | — |
| Sodium metabisulphite | 5.0 g | — |
| Sodium lauryl sulphate | 9.5 g | — |
| Water | 2000.0 g | — |

The aqueous dispersion was applied to the pretreated surface of the film support and dried at 90° C. for 1 minute to give a dried coat weight of 1.5 mg/dm$^2$. An aqueous gelatinous subbing solution comprising 1 g of gelatin per 100 g of water was applied to the subbing layer and seasoned at 105° C. for 3.5 minutes. A gelatino silver halide lith emulsion was applied to the gelatinous subbing layer, chilled and dried at 30° C. for 30 minutes. The dried film was then aged for 16 hours at room temperature under normal atmospheric conditions before being tested.

Control experiments were carried out by preparing sensitised films by the procedure described above except that the subbing copolymers were prepared from the following comonomers:

| | Monomers | Mole % of monomers |
|---|---|---|
| Control A | Vinylidene chloride | 85 |
| | Methyl acrylate | 8 |
| | Acrylamide | 7 |
| Control B | Vinylidene chloride | 85 |
| | Methyl acrylate | 13 |
| | Itaconic acid | 2 |

The wet, dry, and alkaline adhesion and spirit resistance of the films of Example 1 and Controls A and B were assessed, by the procedure described above, with the following results:

| | Grade of normal wet adhesion | Grade of normal dry adhesion | Grade of adhesion in alkaline developer | Grade of spirit resistance |
|---|---|---|---|---|
| Example 1 | 1 | 1 | 1 | 1 |
| Control A | 3 | 1 | 3 | 2 |
| Control B | 4 | 2 | 5 | — |

These properties indicate tha the subbing copolymer layer of Example 1 provides superior adhesion and spirit resistance to the film support over Controls A and B.

EXAMPLE 2

A biaxially oriented polyethylene terephthalate film support, 0.004 inch thick, was pretreated on one surface with p-chlororesorcinol generally as described in Example 1, and an aqueous dispersion of a vinylidene chloride subbing copolymer was applied to the pretreated surface. The subbing copolymer was prepared by admixing the following reagents in a reaction vessel and allowing the polymerisation to run to completion.

| | Quantity | Mole % of monomers |
|---|---|---|
| Vinylidene chloride | 402.5 g | 83 |
| Methyl acrylate | 34.4 g | 8 |
| Itaconic acid | 26.0 g | 2 |
| N-methylolacrylamide | 34.7 g | 7 |
| 'Solumin' FP 85 SD (a commercially available sodium salt of a sulphated alkyl phenoxy polyethoxy ethanol) | 18.0 g (added as a 25% by weight aqueous solution) | — |
| Ammonium persulphate | 0.8 g | — |
| Sodium metabisulphite | 1.5 g | — |
| Water | 1500.0 g | — |

The subbing copolymer layer was dried to give a dry coat weight of 1.5 mg/dm$^2$ and overcoated with a gelatin subbing solution as described in Example 1. The resulting subbed base was seasoned for 4 minutes at 105° C. The gelatin subbing layer was overcoated with a gelatino lith emulsion according to Example 1. The wet and dry adhesions, adhesion in alkaline developer, and spirit resistance of a subsequently coated gelatin silver halide lith emulsion to the subbed film were all Grade 1 and entirely satisfactory for graphic arts use.

EXAMPLE 3

A subbing copolymer was prepared from the following comonomers:

| | Mole % of monomers |
|---|---|
| Vinylidene chloride | 85 |
| Methyl acrylate | 6 |
| Monomethyl itaconate | 2 |
| Acrylamide | 7 |

The subbing copolymer was coated as a 3% by weight aqueous dispersion onto one surface of a p-chlororesorcinol pretreated biaxially oriented polyethylene terephthalate film of 0.004 inch thickness, dried and overcoated with an aqueous gelatin subbing solution according to Example 1. The coated film was then seasoned for 3.5 minutes at 105° C. A gelatin silver halide lith emulsion applied to the gelatin subbing layer exhibited Grade 1 wet and dry adhesions and adhesion in alkaline developer and Grade 1–2 spirit resistance.

EXAMPLE 4

A biaxially oriented polyethylene terephthalate film of thickness 0.004 inch was pretreated on one surface with an aqueous solution of p-chlororesorcinol according to Example 1, and was overcoated with an aqueous copolymer dispersion prepared as described in Example 1 from the following comonomers:

| | Mole % of monomers |
|---|---|
| Vinylidene chloride | 85 |
| Acrylonitrile | 8 |
| Itaconic acid | 2 |
| Acrylamide | 5 |

The copolymer dispersion coating was dried and overcoated with a 1% by weight aqueous gelatin subbing solution which was dried and seasoned according to Example 3. The coated film was then divided into two pieces. To one piece of the film was applied a gelatin silver halide lith emulsion. The wet and dry adhesions, adhesion in alkaline developer and spirit resistance were Grade 1 in each case. To the second piece of the coated film was applied a light-sensitive gelatin silver halide X-ray emulsion. The photographic material thus obtained possessed Grade 1 wet and dry adhesions.

EXAMPLE 5

A subbing copolymer was prepared in an analogous procedure to that described in Example 2 from:

| | Mole % of monomers |
|---|---|
| Vinylidene chloride | 83 |
| Vinyl acetate | 10 |
| Itaconic acid | 1.5 |
| Acrylamide | 5.5 |

The subbing copolymer was applied as a 3% by weight aqueous dispersion to one surface of a biaxially oriented polyethylene terephthalate film of thickness 0.004 inch which had been pretreated with p-chlororesorcinol according to Example 1. The copolymer subbing layer was subsequently dried and overcoated with an aqueous gelatin subbing solution and the resulting coated film base seasoned in a manner described in Example 3. A gelatin silver halide emulsion applied over the gelatin subbing layer exhibited Grade 1 wet and dry adhesions, adhesion in alkaline developer and spirit resistance.

EXAMPLE 6

A biaxially oriented polyethylene terephthalate film of thickness 0.004 inch was pretreated on one surface with a solution containing 3 g of resorcinol and 0.2 ml of 25% by weight aqueous solution of 'Solumin' FP 85 SD in 100 g of water, dried at 90° C. and seasoned for 45 seconds at 100° C.

An aqueous copolymer dispersion was prepared according to Example 2 from the following comonomers:

| | Mole % of monomers |
|---|---|
| Vinylidene chloride | 85 |
| Methyl acrylate | 8 |
| Itaconic acid | 1.5 |
| Acrylamide | 5.5 |

This subbing copolymer dispersion was applied to the pretreated film, dried and overcoated with an aqueous gelatin subbing solution which was dried and seasoned as described in Example 1. A subsequently applied gelatin silver halide emulsion exhibited Grade 1 wet and dry adhesions, adhesion in alkaline developer and spirit resistance.

EXAMPLE 7

A polyethylene terephthalate film was melt extruded, cast onto a cooled rotating drum and stretched in the direction of extrusion about 3 times its original dimensions by conventional procedures. The stretched film was then coated on both surfaces with an aqueous dispersion containing 10 g in 100 g of water of the subbing copolymer described in Example 6.

The coated film was dried and stretched transversely about 3 times its original dimensions and heat set at a temperature of about 200° C. by conventional procedures. After the film had cooled, an aqueous gelatin subbing layer was applied, dried and seasoned according to Example 3. A gelatin silver halide lith emulsion was applied over the gelatin subbing layers and exhibited Grade 1 wet and dry adhesions, adhesion in alkaline developer and spirit resistance.

EXAMPLE 8

A conventionally biaxially oriented 0.004 inch thick clear polyethylene terephthalate film which had been pretreated on both surfaces with a cross-linked copolymer formed from, by weight 45% ethyl acrylate. 50% methyl methacrylate and 5% methacrylamide was overcoated on both surfaces with the subbing copolymer described in Example 6. An aqueous gelatin subbing layer was applied to each surface, dried and seasoned according to Example 3. A gelatin silver halide lith emulsion was applied to the gelatin subbing layers. The wet and dry adhesions, adhesion in alkaline developer and spirit resistance were all Grade 1.

CONTROL EXAMPLES C, D AND E

Subbing copolymers were prepared according to Example 2 from the following comonomers:

| | Monomers | Mole % of monomers |
|---|---|---|
| Control C | Vinylidene chloride | 85 |
| | Methyl acrylate | 6 |
| | Itaconic acid | 2 |
| | N-tert-butylacrylamide | 7 |
| Control D | Vinylidene chloride | 76.6 |
| | n-butyl acrylate | 4.2 |
| | Itaconic acid | 1.6 |
| | N-tert-butylacrylamide | 17.6 |
| Control E | Vinylidene chloride | 90.6 |
| | Itaconic acid | 1.5 |
| | N-tert-butylacrylamide | 7.9 |

The subbing copolymers were applied an aqueous dispersions to both surfaces of a p-chlororesorcinol pretreated biaxially oriented polyethylene terephthalate film and were further overcoated and treated with a gelatin subbing layer and a lith emulsion as described in Example 1. The adhesions of the resulting photographic film bases were assessed with the following results:

| | Grade of normal wet adhesion | Grade of normal dry adhesion | Grade of adhesion in alkaline developer | Grade of spirit resistance |
|---|---|---|---|---|
| Control C | 5 | 1 | 5 | 4 |
| Control D | 5 | 5 | 5 | 5 |
| Control E | 5 | 5 | 5 | 5 |

The materials produced were not suitable for use as graphic arts photographic materials.

EXAMPLES 9 to 13 AND CONTROL EXAMPLES F AND G

Example 2 was repeated to apply aqueous subbing dispersions of vinylidene chloride/methyl acrylate/itaconic acid/acrylamide copolymers which has been prepared from various comonomeric formulations as specified in the table below. The table also indicates the adhesion properties of the resulting photographic films.

TABLE

| Example | Mole % composition of monomers in subbing copolymer preparation, vinylidene chloride/ methyl acrylate/ itaconic acid/acrylamide respectively | Grade of normal wet adhesion | Grade of normal dry adhesion | Grade of adhesion in alkaline developer | Grade of spirit resistance |
|---|---|---|---|---|---|
| 9 | 84/11/2/3 | 1–2 | 1 | 1–2 | 2 |
| 10 | 83/11/2/4 | 1 | 1 | 1 | 1–2 |
| 11 | 86/7/1/6 | 1 | 1 | 1 | 1 |
| 12 | 84.7/6.1/2/7.2 | 1 | 1 | 1 | 1 |
| 13 | 83/7/2/8 | 1 | 2 | 1 | — |
| Control F | 84/12/2/2 | 4 | 1 | — | — |
| Control G | 83/5/2/10 | 4 | 5 | — | — |

The adhesion properties of the films produced in Examples 9 to 13 were satisfactory and the films were suitable for graphic arts use. By contrast the films of Control Examples F and G were unsuitable for photographic use on account of their poor wet and dry adhesions. The adhesion in alkaline developer and spirit resistance of the control films were not measured in view of their unacceptable wet and dry adhesions but such properties are also undoubtedly poor and unacceptable.

EXAMPLES 14 TO 16

Example 1 was repeated to apply aqueous subbing dispersions of vinylidene chloride/methyl acrylate/itaconic acid/acrylamide copolymers which had been prepared from various comonomeric formulations as specified in the table below, with the exception that the gelatin subbing layer was seasoned for 4 minutes at 105° C. The table also indicates the adhesion properties of the resulting photographic films.

TABLE

| Example | Mole % composition of monomers in subbing copolymer preparation, vinylidene chloride/ methyl acrylate/ itaconic acid/acrylamide respectively | Grade of normal wet adhesion | Grade of normal dry adhesion | Grade of adhesion in alkaline developer | Grade of spirit resistance |
|---|---|---|---|---|---|
| 14 | 8-0/-13/2/5 | 1 | 1 | 1 | 1 |
| 15 | 88-/5/1/6 | 1 | 1 | 1 | 1–2 |
| 16 | 83-/6/4/7 | 1 | 1 | 1 | 1–2 |

The resulting photographic films had adhesion properties such that the films were suitable for graphic arts use.

EXAMPLES 17 TO 20

Aqueous copolymeric subbing dispersions were prepared by the general procedure specified in Example 2 using the polymerisation formulation set out therein with the substitution of the following comonomers:

| Example | Monomers | Mole % of monomers |
|---|---|---|
| 17 | Vinylidene chloride | 85 |
| | Ethyl acrylate | 8 |
| | Itaconic acid | 1.5 |
| | Acrylamide | 5.5 |
| 18 | Vinylidene chloride | 85 |
| | n-butyl acrylate | 6 |
| | Itaconic acid | 2 |
| | Acrylamide | 7 |
| 19 | Vinylidene chloride | 85 |
| | Methyl methacrylate | 6 |
| | Itaconic acid | 2 |
| | Acrylamide | 7 |
| 20 | Vinylidene chloride | 85 |
| | Methyl acrylate | 8 |
| | Itaconic acid | 1.5 |
| | Methacrylamide | 5.5 |

The aqueous dispersions were applied to the pretreated surfaces of biaxially oriented polyethylene terephthalate of thickness 0.004 inch. The surface pretreatment was with p-chlororesorcinol generally as described in Example 1. The copolymeric subbing layers were further coated with gelatin subbing layers of the formulation specified in Example 1. The gelatin subbing layers were seasoned at 105° C. for 3.5 minutes in Examples 17 to 19 and at 108° C. for 3.5 minutes in Example 20. The gelatin subbing layers were further coated with a gelatin silver halide lith emulsion according to Example 1. The photographic films of Examples 17 to 20 exhibited Grade 1 wet and dry adhesions, adhesion in alkaline developer and spirit resistance. For Example 20, the dry adhesion and spirit resistance were both Grade 1 and the wet adhesion and adhesion in alkaline developer were both Grade 1-2. The photographic films in each case were suitable for graphic arts use.

I claim:

1. A photographic film which comprises a self-supporting plastics film support, a subbing layer of a copolymer of vinylidene chloride applied to one or both surfaces of the film and a light-sensitive photographic emulsion layer applied over the subbing layer(s), wherein the subbing layer(s) comprise a copolymer prepared from:

75 to 90 mole % of vinylidene chloride, 2 to 16 mole % of a copolymerisable ester of a carboxylic acid, or acrylonitrile or methacrylonitrile, 0.5 to 5 mole % of itaconic acid or a monoalkyl ester of itaconic acid wherein the alkyl group contains 1 to 4 carbon atoms, and 3 to 8 mole % of acrylamide, methacrylamide or N-methylolacrylamide, (mole percentages being based on the total comonomeric composition).

2. A photographic film according to claim 1, in which the copolymerisable ester comprises an ester of an $\alpha,\beta$-unsaturated monocarboxylic acid or an $\alpha,\beta$-unsaturated dicarboxylic acid.

3. A photographic film according to claim 2, in which the ester comprises methyl, ethyl, isobutyl, butyl, octyl, 2-ethylhexyl acrylate or methacrylate, or vinyl acetate.

4. A photographic film according to claim 1, in which the copolymerisable ester, acrylonitrile or methacrylonitrile is employed in an amount 6 to 10 mole % of the total monomeric composition.

5. A photographic film according to claim 1, in which the monoalkyl ester of itaconic acid comprises monomethyl itaconate.

6. A photographic film according to claim 1, in which the itaconic acid or monoalkyl ester of itaconic acid is employed in an amount 0.5 to 3 mole % of the total monomeric composition.

7. A photographic film according to claim 1, in which the acrylamide, methacrylamide or N-methylolacrylamide is employed in an amount of 4 to 7 mole % of the total monomeric composition.

8. A photographic film according to claim 1, in which the subbing copolymer is prepared from 82 to 88 mole % of vinylidene chloride, 6 to 10 mole % of methyl acrylate, 1 to 3 mole % of itaconic acid and 5 to 7 mole % of acrylamide.

9. A photographic film according to claim 8, in which the subbing copolymer is prepared from 85 mole % of vinylidene chloride, 6 mole % of methyl acrylate, 2 mole % of itaconic acid and 7 mole % of acrylamide.

10. A photographic film according to claim 1, in which the film support comprises a biaxially oriented and heat-set polyethylene terephthalate film.

11. A photographic film according to claim 1, in which a gelatin subbing layer is interposed between the copolymeric subbing layer and the light-sensitive photographic emulsion layer.

12. A photographic film according to claim 1, in which the light-sensitive photographic emulsion layer comprises a gelatinous silver halide emulsion.

13. A process for the production of a photographic film which comprises applying a subbing layer to one or both surfaces of a self-supporting plastics film support, said subbing layer comprising a copolymer prepared from:

75 to 90 mole % of vinylidene chloride, 2 to 16 mole % of a copolymerisable ester of a carboxylic acid, or acrylonitrile or methacrylonitrile, 0.5 to 5 mole % of itaconic acid or a monoalkyl ester of itaconic acid wherein the alkyl group contains 1 to 4 carbon atoms, and 3 to8 mole % of acrylamide, methacrylamide or N-methylolacrylamide, (mole percentages being based on the total comonomeric composition), and applying a light-sensitive photographic emulsion over the subbing layer(s).

14. A process for the production of a photographic film according to claim 13, in which the subbing copolymer composition is applied to the film support after the production of the film has been completed.

15. A process for the production of a photographic film according to claim 13, in which the subbing copolymer composition is applied to the film support during the production of the film.

* * * * *